US008556067B2

(12) United States Patent
Fenile

(10) Patent No.: US 8,556,067 B2
(45) Date of Patent: Oct. 15, 2013

(54) CONVEYOR SYSTEM AND METHOD FOR CONVEYING PLANAR PRODUCTS

(75) Inventor: Roberto Fenile, Wetzikon (CH)

(73) Assignee: Ferag AG, Hinwil (CH)

( * ) Notice: Subject to any disclaimer, the term of this patent is extended or adjusted under 35 U.S.C. 154(b) by 510 days.

(21) Appl. No.: 12/744,145

(22) PCT Filed: Nov. 18, 2008

(86) PCT No.: PCT/CH2008/000488

§ 371 (c)(1),
(2), (4) Date: Sep. 1, 2010

(87) PCT Pub. No.: WO2009/065242

PCT Pub. Date: May 28, 2009

(65) Prior Publication Data

US 2010/0314220 A1 Dec. 16, 2010

(30) Foreign Application Priority Data

Nov. 22, 2007 (CH) ..... 1806/07

(51) Int. Cl.
*B65H 29/003* (2006.01)
*B65H 29/00* (2006.01)

(52) U.S. Cl.
CPC .... *B65H 29/003* (2013.01); *B65H 2301/44712* (2013.01); *B65H 2301/4473* (2013.01); *B65H 2301/44732* (2013.01)
USPC ..... 198/644; 198/470.1; 198/803.3; 198/803.7; 198/803.9

(58) Field of Classification Search
USPC ..... 198/470.1, 644, 867.02, 867.05, 198/867.07, 803.3, 803.7, 803.8, 803.9
See application file for complete search history.

(56) References Cited

U.S. PATENT DOCUMENTS

| | | | | |
|---|---|---|---|---|
| 4,381,056 | A * | 4/1983 | Eberle | 198/803.7 |
| 4,512,457 | A * | 4/1985 | Reist et al. | 198/470.1 |
| 4,552,349 | A | 11/1985 | Loos et al. | |
| 4,905,818 | A * | 3/1990 | Houseman | 198/803.7 |
| 5,244,078 | A * | 9/1993 | Silva et al. | 198/464.3 |
| 5,360,101 | A * | 11/1994 | Carlen | 198/803.7 |
| 5,380,000 | A * | 1/1995 | Ohno | 271/277 |
| 5,388,820 | A * | 2/1995 | Eberle et al. | 271/277 |
| 5,935,151 | A * | 8/1999 | Broughton et al. | 606/241 |
| 6,394,449 | B1 * | 5/2002 | Reist | 271/204 |
| 6,578,843 | B2 * | 6/2003 | Honegger | 271/204 |
| 6,976,674 | B2 * | 12/2005 | Honegger | 271/204 |

FOREIGN PATENT DOCUMENTS

| | | |
|---|---|---|
| DE | 195 23 164 | 2/1996 |
| WO | 98/03419 | 1/1998 |
| WO | 2007/062534 | 6/2007 |

* cited by examiner

*Primary Examiner* — Mark A Deuble
(74) *Attorney, Agent, or Firm* — Rankin, Hill & Clark

(57) ABSTRACT

The conveyor system for planar products (60), in particular print shop products, features a feeder device (50) as well as a gripper conveyor (10) with a plurality of grippers (12) that move along an orbital track (U), wherein the grippers (12) each include two gripper parts (14, 16) that can be pivoted relative to one another between an open position and a closed position. The relative position of the gripper parts (14, 16) to one another and/or the orientation of the whole gripper (12) in space is a function of its position along the orbital track and is set by at least one control guide (28, 30, 40, 80, 80') that interacts with the grippers such that the gripper parts (14, 16) can be moved from an open position to a closed position while moving through a transfer area (A) of the orbital track (U) for the transfer of products (60) from the feeder device (50).

16 Claims, 4 Drawing Sheets

CONVEYOR SYSTEM AND METHOD FOR CONVEYING PLANAR PRODUCTS

BACKGROUND OF THE INVENTION

1. Field of the Invention

The invention pertains to the field of conveyor technology, in particular to the conveyance of planar products like, e.g., print shop products.

2. Description of Related Art

In the production of planar products, in particular print shop products, as a rule it is necessary to transfer the products from one conveyor device to another. For overcoming great distances of conveyance, or for separation for the purposes of handling, the further conveyor device is often a gripper conveyor in which many grippers are moved along a closed orbital track. One such device, with which it is possible to transfer products that are delivered by a feeder device in the form of a belt conveyor to a gripper conveyor, is for example disclosed in EP-A 0557 680 or CH 655 488. The arriving products, which are in an imbricated formation, are individually gripped by each respective gripper in a transfer area of a curved or straight orbital track. For this purpose, the parts of each gripper are movable from an open position to a closed position, and vice-versa. Control is provided by a stationary control guide (opening-closing guide) that interacts with a control element on the gripper, e.g. a control cam or a slide. Depending on the design of the grippers, their orientation with respect to the orbital track can also be adjusted by means of a control guide. The position along the orbital track at which the grippers are closed or opened, and if applicable the change in orientation that is attained by the gripper, is determined by the shape and location of the corresponding control guide. In known conveyor systems, the control guide is stationary, such that all the grippers go through the same movement and thus at the same opening- and/or closing location open and/or close, and/or are pivoted in a similar manner.

In the processing of planar products, in particular print shop products, it can occur that defective products are found in the conveyor stream. These should be rejected from the conveyor stream at the earliest possible point in time, so as not to disrupt further production and conveyance activities. This problem arises, for example, when print shop products are wrapped in a common wrapping film: if the casing or number of products is faulty, the packet of individual products can fall apart when transported further by means of a gripper conveyor. If possible, such a packet should therefore be ejected from the conveyor stream subsequent to the erroneous preceding step and before the transfer of the product to the gripper conveyor. With the conveyor systems that are known until now this is only possible to achieve by moving the feeder device as a whole into a position in which the grippers can not take up the product, e.g. by rotating it out of the transfer area in the manner of a see-saw. This is mechanically complex.

BRIEF SUMMARY OF THE INVENTION

It is an object of the present invention to provide an improved conveyor system for planar products, with which specific products can not be taken up during the transfer between a feeder device and a gripper conveyor.

According to the invention, the conveyor system for planar products, in particular print shop products, features a feeder device as well as a gripper conveyor. The feeder device can, for example, be a belt conveyor, upon whose belt the products lie singly or in an imbricated formation. These can, for example, be found at the exit of a wrapper route, wherein the conveyed products are then, for example, print shop products wrapped with a film. The gripper conveyor has in a known manner a plurality of grippers, which are moved along a closed orbital track. The grippers each have two gripper parts which can be pivoted relative to one another such that an open position and a closed position as well as, if applicable, intermediate positions can be engaged. The position of the gripper parts and/or their orientation with respect to the orbital track is a function of the position of the grippers along the orbital track and is set by means of at least one control device. This features at least one control guide, i.e. a control cam, which interacts with the grippers over at least a partial section of the orbital track. This control guide is, for example, a stationary closing guide or a unlocking- and/or opening element or a guide with which can be achieved a pivoting of one or both gripper parts relative to the orbital track. For the taking-up of a product from the feeder device, in a transfer area of the orbital track, the grippers are controlled by the control device such that the gripper parts are able to be moved from the open position to the closed position. Thus, a product can be taken up, held fast, and in this held condition be conveyed further.

According to the invention, the grippers are controllable by the control device in such a way that individual grippers can selectively be moved through the transfer area without taking up a product from the feeder device for further transport. This can be achieved in several ways: for example by one or more of the following means: non-opening of individual grippers before and/or in the transfer region, or displacement of the closing location such that products can not be taken up by the closed gripper; pivoting of individual grippers relative to the orbital track before or in the transfer area, such that products are not introduced into the gripper; opening of individual grippers in the transfer area, such that the product is in fact introduced, but not gripped and subsequently falls out. The control device features at least one controllable control guide with at least one moveable element, e.g. a moveable guiding face or a switchable deflector; preferably it features moveable opening and/or closing guides and/or moveable guides for the alteration of the position and/or orientation of the grippers. These can be used singly or also in combination with stationary guides. The guiding faces of the moveable guides can, for example, occupy different positions in space and, depending on the position, either function as active guiding faces interacting with the grippers or have no influence upon the grippers. An alteration to the course of motion of individual grippers can thereby be achieved. Preferably, a control unit serves for the control of the moveable guides.

The transfer area is to be understood as a section of the grippers' orbital track in which in principle the gripper can interact with the product that is conveyed by the feeder device, in order to grip it. Respectively, the product is to be understood as a unit to be conveyed; a product can also consist of several sub-products. The products can also be product parts, stuck-together or collected products; they can lie separately or in (sub)stacks; they can be wrapped or unwrapped. For example, the term refers to print shop products wrapped with film. In this example, products for which the wrapping is defective or not present, or which have defective sub-products or product parts, are screened out.

The method according to the invention features the following steps: conveying of the product with the feeder device, gripping and further conveying of the product by means of the gripper of the gripper conveyor by bringing the gripper parts from the open position to the closed position in the transfer area; and control of the open and/or closed position and/or the orientation of the gripper in such a way that selectively individual grippers can be moved through the transfer area without taking up a product from the feeder device.

The conveyor system affording to the invention and the corresponding method of conveying have the advantage that individual products can be selectively rejected at the point at which products are transferred from the feeder stream to the gripper conveyor, and thus not conveyed further. They are, thus, sorted out in the transfer area between the feeder device and the gripper conveyor by not being gripped. There they fall downwards, for example by force of gravity, and can be disposed of. Preferably, in addition they are actively forced downward there by the grippers. In this way the danger is minimized that product parts end up in the further conveyance path and cause problems there.

For the setting of the position of the gripper parts relative to one another and/or the orientation thereof, the grippers preferably have control elements, which interact with at least one guiding face of the control guide of the control device. Any type of gripper is itself usable for the operation according to the invention, provided that the control guide is correspondingly adjusted.

Preferably the grippers as a whole can be pivoted relative to the orbital track. It is preferred that the pivoted position (orientation of the gripper jaw with respect to the orbital track) and the position of the gripper parts relative to one another (the gripper jaw's state of opening) can be set independently. Therewith the non-taking-up and/or the rejection of a product can for example be achieved by the pivoting away of the gripper. The alteration of the orientation can be achieved without substantial application of force and for this reason has the advantage that the corresponding guide can be designed with a simple construction and light material and be subject to limited wear and tear. Furthermore, this makes possible rapid switching operations.

The grippers can for example be designed as described in EP-A 0 600 183, EP-A 0557 680 or WO 2007/115421, which are here included by reference. These grippers have two control elements in the form of control cams. A control guide (opening and/or closing guide) interacts with one of the control cams and in this manner controls the movement of one of the gripper parts, such that thereby in this way the open and/or closed position and/or in general the gripper jaw's state of opening is defined. A further control guide (positioning guide) interacts with a second control cam and thereby defines the orientation of the second gripper part, and so the whole gripper independently, from its state of opening. The gripper's pivoted position and its state of opening can be set independently.

The gripper parts according to EP-A 0 600 183, EP-A 0557 680 or WO 2007/115421 are pre-stressed in the open position and in the closed state are locked by a locking mechanism. The gripper can be opened through release of the locking by means of an unlocking element (opening element) that interacts with the locking mechanism.

The opening and/or closing location of the gripper along the orbital track as well as its orientation and/or alteration of orientation is defined by the shape of the control guide(s) and/or by the shape of the guiding face(s) thereupon that interact(s) with the control element(s). Control guide should be understood to mean also the unlocking element mentioned above.

In order to reject a product, the guiding face and the closing location associated thereto are, for example, altered so that the closing location lies in the direction of travel before the transfer area and/or before the closing location usually used for the taking-up of a product; it can also suffice that only one part of the gripper is pivoted away, without the gripper being closed completely. Alternatively, the gripper can be moved to and into the transfer area without being closed at all, and/or can be moved through the transfer area in a closed state and/or pivoted, in an open or closed state, so that it is not possible to take up a product. A further alternative is the pivoting away of the gripper or a part of the gripper without displacing the closing locating, so that due to the altered orientation the gripper can no longer take up a product.

In a preferred development of the invention, the position of the guiding face(s) of the control guide(s) with regard to the orbital track can be altered in a controlled manner by a control unit. Thus, the course of action of the opening and/or closing event can be adjusted in such a manner that a specific product is not taken up. For this purpose at least one control guide is preferably slideable or pivotable with regard to the orbital track in at least one partial section of the orbital track. The control guide can also act upon with the gripper in a very small partial section of the orbital track, in order to achieve a very rapid opening and/or closing event. Thus, this can be assisted by the gripper being pre-stressed in the open or closed position, as in EP-A 0 600 183, EP-A 0557 680 or WO 2007/115421.

In another development of the invention, two or more alternative guiding faces of the control guide(s) are present. These are stationary, so that switching between them can be accomplished by means of a deflector. According to the deflector position, the control element of the gripper runs selectively along either the one or the other of the guiding faces. Alternatively, a stationary and a moveable control guide can be present, whose guiding faces according to position of the moveable control guide alternately function as active guiding faces and define the sequence of motion. In both cases the gripper parts thus pass through the pattern of movement that is defined by the shape of the active guiding face, e.g. taking up of a product or pivoting away before the transfer position; normal or, as the case may be, early closing event. With both variants, very short reaction times are achieved, which in particular make possible an operation only upon individual grippers. An individual switching and with it an individually controlled gripper is thus also possible in the case of high conveyor speeds. Both variants also allow that no heavy parts must be moved, e.g. only the deflector or only one of the orientations of one of the gripper parts or of the whole gripper (without substantial application of force) are altered by the guide.

A deflector that can be used herein is, for example, described in the non-published Swiss patent application Nr. 1888/06. Other deflectors are also usable.

For the detection of a product to be rejected, preferably a control signal from an upstream conveyor or machine component is used to give notice of an error function. Alternatively or in addition, a detection device can be present, in particular an optical sensor, which is located before the gripper conveyor with respect to the direction of conveyance of the feeder device. In both cases, a control signal is conveyed to the control unit that a product that is not to be taken up is present in the feeder stream.

Preferably the gripper conveyor is designed such that its feeder device is at least partly present in the transfer area itself. The grippers approach from above via their movement along the orbital track. Products that are not taken up can, thus, be easily purged downward, assisted by gravity, without disturbing the movement of the grippers. For this purpose, the feeder device ends, for example, near or underneath the gripper conveyor.

In an advantageous development, the gripper can fulfill a double function: on the one hand it serves for the taking up of products that are to be conveyed further and on the other hand—via a corresponding movement of the gripper parts—for the active deflection of products that are not to be taken up. The taking up of products as well as the active rejection will be described more fully below with reference to the figures.

BRIEF DESCRIPTION OF THE DRAWINGS

Examples of the invention are depicted in the figures and described below. Schematically are shown.

DETAILED DESCRIPTION OF THE INVENTION

Figure 1A:
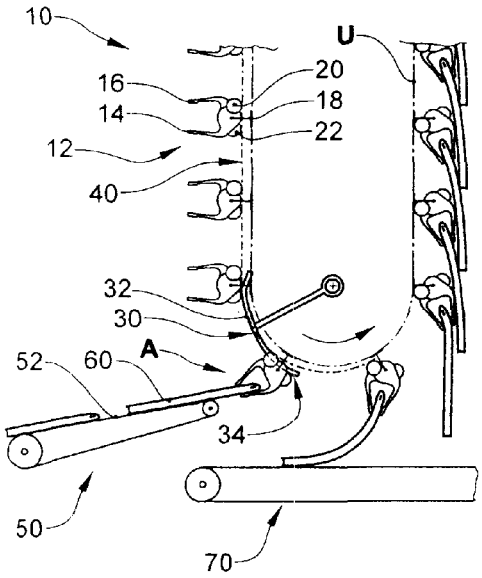
FIGS. 1 and 2 the taking up of products and well as the rejection of individual products according to the state of the art.

FIGS. 1*a*+*b* depict two different snapshots of a conveyor system with a gripper conveyor 10 and a feeder device 50 according to the state of the art during the transfer of products 60. The present invention builds upon such a conveyor system, which is why this will be described below.

A plurality of grippers 12 are moved along a closed orbital track U, which here features two substantially vertically-running straight parts and curved connecting pieces therebetween. The orbital track is, for example, defined by the track of a drive element for the grippers 12 not described in detail. Here the grippers 12 are moved counterclockwise from above to below—toward the feeder device 50—and then upward once again.

The feeder device 50 is located on the left-hand side underneath the gripper conveyor 10. It consists of a belt conveyor with a conveyor belt 52 that is oriented such that the products 60 that lie thereupon are brought into the reach of the grippers 12. For this purpose here the conveyor belt 52 is set at a slight incline and ends before the space that the grippers 12 traverse during their motion along the orbital track.

The grippers 12 are pivotably connected to the drive element as a whole by means of a supporting element 18. Furthermore, the grippers 12 feature two gripper parts 14, 16 which can be rotated relative to one another in order that an open position and a closed position as well as, if applicable, intermediate positions can be engaged. Control elements 20, 22—here control rolls—on the grippers 12 which interact with stationary control guides, i.e. control cams 30, 40 serve for the setting of the pivoted position of the whole gripper 12 relative to the orbital track U as well as for the setting of the position of the gripper parts 14, 16 relative to one another.

The control guide 40 runs substantially parallel to the left-hand part of the orbital track U. It interacts with one of the control elements, namely with the trailing control cam 20, which is associated with the gripper part 16 that is behind in the direction of conveyance. Via this control guide 40, together with the control element 20 the orientation of the whole gripper and/or of the trailing gripper part 16 is set relative to the orbital track U. Here the orientation is selected such that the trailing gripper part 16 runs approximately perpendicular to the orbital track, and with it the gripper jaw in its open state is oriented substantially perpendicular to the orbital track. In the case that the control guide 40 is not present in the right-hand part of the orbital track U, the grippers 12 hang downward from their supporting element 18 due to gravity or their opening springs.

The further control guide 30 serves for the closing of the open gripper. It interacts with the second control element in the lower section of the orbital track U, namely the preceding control cam 22, which is associated with the gripper part 14 that is leading in the direction of conveyance. The guiding face 32 is for this purpose formed in with an outward curve with respect to the orbital track. With this it pushes the control cam 22 outward with respect to the orbital track U as the gripper moves along the orbital track. Through this, the leading gripper part 14 is pushed toward the trailing gripper part 16 and the gripper 12 is closed. The leading gripper part 14 can be pivoted away, without substantial application of force, up to just before the achievement of the actual closed state; not until the finalized closing and locking is the force that will be executed by the closing guide 30 necessary.

Figure 2A:
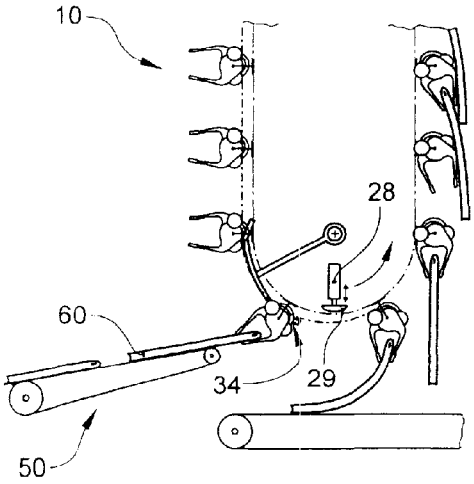
Figure 2B:
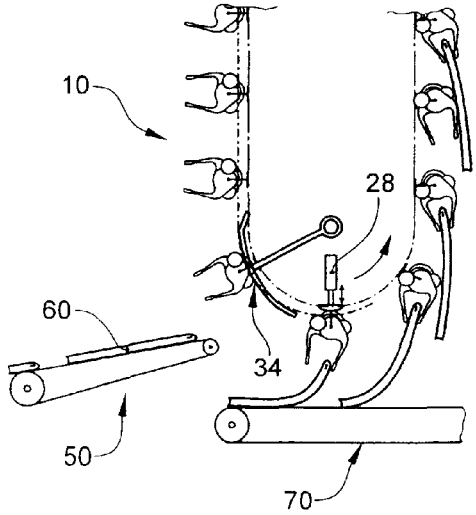
Figure 3:
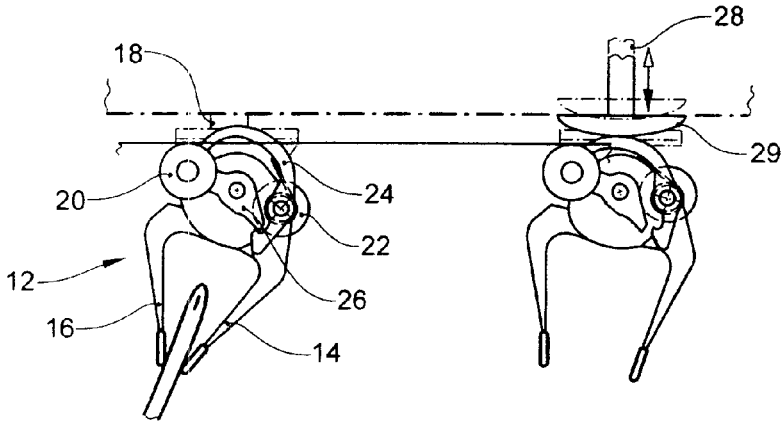
FIG. 3 a detailed view of a gripper for the illustration of an opening mechanism.

As is depicted in more detail in FIG. 3, the gripper 12 contains a locking mechanism in the form of locking clip 24 and a locking latch 26, which respectively are attached to one of the gripper parts 14, 16 and snap together with one another in the closed state. By means of the locking mechanism, the gripper 12, once closed, remains closed without requiring a continuously applied external force and/or control guide. This snapping together can be released by a control guide in the form of an unlocking element 28, which is outlined e.g. in FIGS. 2*a*+*b* or 3. The guiding face 29 of the unlocking element 28 presses on the locking clip 24, whereby it is pivoted and released from the locking latch 26. Because of the prestress, the gripper parts 14, 16 thereupon resume the open position.

The unlocking element 28 and/or its guiding face 29 are arranged such that each gripper 12 that passes is opened. In order to open selectively individual grippers 12, it is also possible that the opening element 28 can be controllably moved relative (e.g. perpendicular) to the orbital track U, as is depicted in FIGS. 2*a*+*b* and in the right-hand part of FIG. 3, e.g. by means of a known drive (hydraulic or pneumatic cylinder, motor).

Figure 1B:
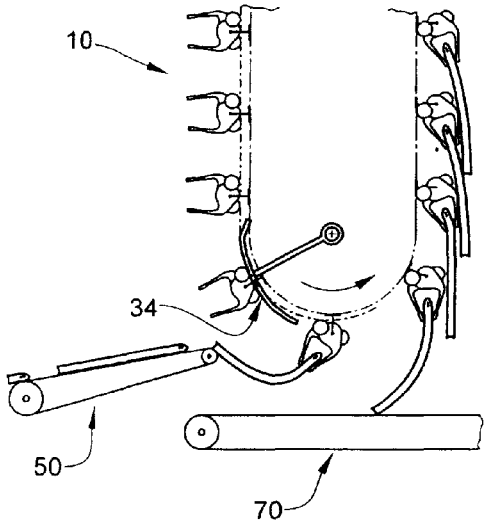

FIGS. 1*a*+*b* depict the closing by means of a stationary control guide 30 of all open grippers that come into the transfer area A. In FIG. 1*a*, the leading product 60 that lies furthest forward upon the conveyor belt 52 is already gripped by a gripper 12; a further open gripper 12 approaches the transfer area A. In FIG. 1*b*, the leading product 60 is already taken up by the gripper from the conveyor belt 52 and conveyed further. The subsequent product 60, which still now lies foremost upon the conveyor belt, is moved in such a way that it is introduced into the open gripper jaw of the next gripper 12. Every product 60 that is conveyed by the feeder device 50 at this junction is thereby introduced into the open grippers 12 and held thereby via the transfer to the closed position. The location of the first closing location with respect to the orbital track is defined by the shape of the control guide 30 and/or its guiding face 32. For the rejection of defective products 60, the feeder device 50 as a whole can be pivoted in the manner of a see-saw.

FIGS. 2*a*+*b* depict a—also known—variant of the device from FIGS. 1*a*+*b*, by which defective products are rejected after being taken up by the gripper. For this a controllable opening guide in the form of an opening element 28, whose guiding face 29 is moveable with respect to the orbital track U, is present after the first closing location 34 in the direction of movement of the gripper 12. According to the position of the guiding face 29, the gripper 12 is subsequently opened by the opening element 28, or not. In this manner, selectively individual grippers 12 can be opened again after the taking-up of a product 60, such that the gripped, defective product 60 falls out. This is then transported away by means of a further conveyor 70. This method is known, but has the disadvantage that initially every one of the products 60 must be taken up by a gripper 12. In the case of defective products, in particular those made of several sub-products, a disruption of the transfer and transport operations can occur, e.g. a jam due to mechanical blockage of the conveyor route by individual products or sub-products.

Figure 4A:
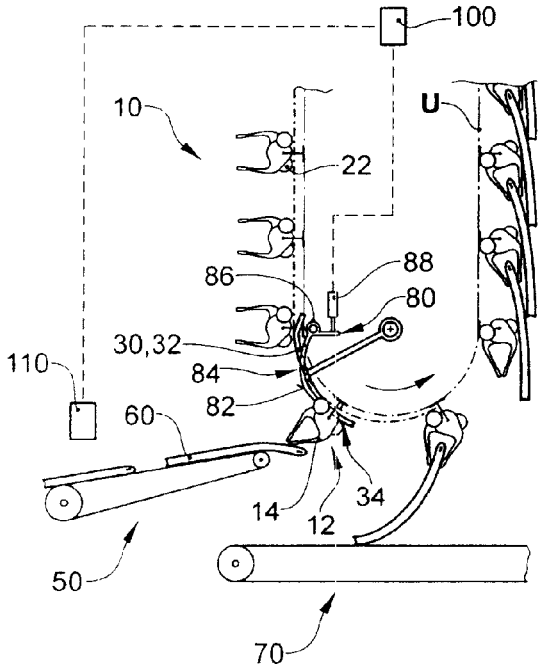
FIG. 4 a device according to the invention with a stationary and a pivotable control guide for the implementation of two different closing locations.

FIGS. 4*a+b* depict an example of the invention with which such problems are avoided. The device is principally designed as in FIGS. 1*a+b*. Instead of each product 60 being taken up and then selectively individual ones being dropped, according to the invention the taking-up of the products 60 by the gripper conveyor 10 is already selectively controllable. So selected individual products 60 are not taken up by the grippers 12 and conveyed further thereby. In the following only the differences with respect to FIGS. 1*a+b* are addressed.

Here, a further control guide 80 is present in the area of the stationary control guide 30 which serves for the control of the closing event. This has a guiding face 82 that is moveable relative to the orbital track U. Here, the guiding face is able to be pivoted about an axis that runs perpendicularly to the orbital track U, it can however also be moveable in the plane of the drawing. The two end locations of the guiding face 82 are depicted in FIG. 4*a* and/or FIG. 4*b*.

The movement of the guide 80 occurs, for example, by means of a drive element 88, e.g. of a hydraulic or pneumatic cylinder, or of a motor, which is controlled by a control unit 100. From the upstream process or from a detection device 110 that is arranged before the gripper conveyor 10 with respect to the direction of conveyance of the feeder device 50, the control unit 100 receives a signal for the rejection of a product 60.

Figure 4B:
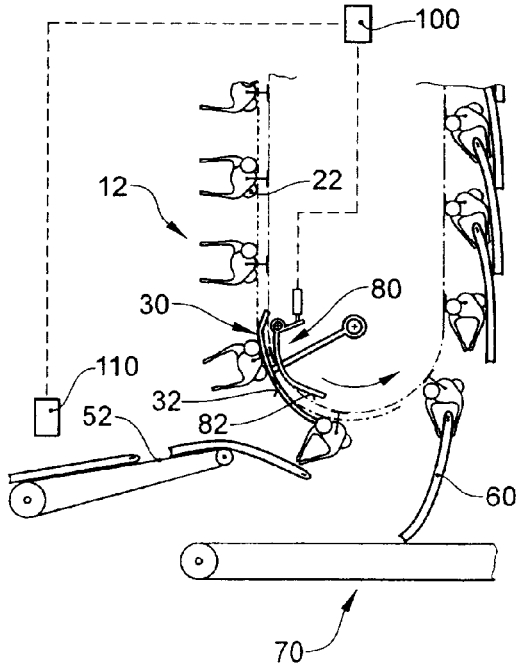

In FIG. 4*b*, the guiding face 82 is arranged completely behind the guiding face 32 of the stationary control guide 30 with respect to the control element 22. So only the stationary guiding face 32 is active; the control element 22 of the gripper 12 does not "notice" anything from the further control guide 80. The grippers 12 will thus as in FIG. 1*a* be closed at the closing location 34 described above, and thus each take up a product 60.

In FIG. 4*a*, at least part of the area of the guiding face 82 is located in front of the guiding face 32 of the stationary control guide 30 with respect to the control element 22. Thus, the control element 22 no longer rolls on the guiding face 32 of the stationary control guide 30, but rather at least on part of the area of the guiding face 82 of the moveable control guide 80. The shape of the resulting "effective" guiding face is different than the one shown in the case of FIG. 4*b*, whereby a different course of motion can be achieved. Here, the leading gripper 14 is pivoted away at a further location 84, without the gripper 12 being fully closed. This further location 84 is defined by the shape of the moveable guiding face 82. With reference to the direction of movement of the grippers 12, this location 84 lies before the normal closing location 34 described above. In this case the gripper part 14 is thus oriented such that the space traversed by it and/or the whole gripper 12 does not overlap with the movement course of the products 60. In the position in which it typically would take up a product 60, the gripper jaw has the "wrong" orientation, and thus no product transfer occurs. The gripper 12 is subsequently closed at the normal closing location 34 (here the moveable guide 80 is again arranged behind the stationary guide 40), but without having gripped a product 60.

The moveable guide 80 must provide for only brief alteration of the orientation of the leading gripper part 14 before the normal transfer and closing location, such that the product passes by the largely closed gripper jaw. This effect can be achieved without substantial application of force, given that the gripper here has not yet taken up a load and no complete closing and latching must be achieved. The moveable guide 80 can thus be designed simply and with a light construction. It must only project beyond the stationary guide 30 and interact with the grippers 12 for a very small section of the orbital track U. Through this, a very fast switching is also possible. Taken together, switching between product take-up and product rejection can be done with minimal effort.

The gripper 12, preferably, is moved such that by its movement through the transfer area A, its leading gripper part 14 imparts a downward deflection to the product 60 that is not to be taken up, which has already arrived at and projects beyond the end of the conveyor belt 52 of the feeder device 50. This product 60 is thus reliably conducted to the further conveyor device 70 and cannot end up in the area between two grippers 12. The deflection can, for example, be achieved by the gripper 12 and/or the gripper part 14, which, after the cessation of influence by the moveable guide 80 in its normal position defined by the stationary guide 30, rebounds and thus imparts a downward impulse to the product.

With respect to the orbital direction, the moveable control guide 80 and/or its guiding face 82 (insofar as it projects beyond the guiding face 32) extends along a length that can be shorter than the distance between two grippers 12. Through this it is possible to influence individual grippers 12.

If the rejection of an individual product 60 should be carried out by altering the closing location of the gripper 12, the control guide 30 described above, which serves for the adjustment of the closing location, can be switched (itself moveable) and/or interact with a moveable control guide in the manner described.

Figure 5:
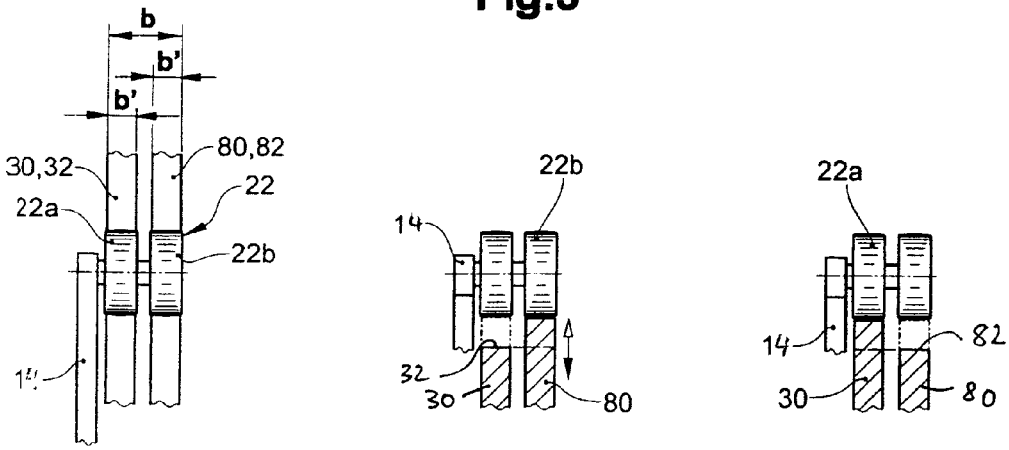
FIG. 5 a detailed view of the control guide from FIG. 4 and the control elements on the gripper associated thereto.

FIG. 5 depicts in more detail how the above-described change of the active guiding face can be mechanically achieved. The control guides 30, 80 are located in two different planes that are in or run parallel to the planes of the orbital track U. The control cam 22 that is attached to gripper part 14 has a width b that is larger than the doubled width b' of the guiding faces 32, 82-measured in a direction perpendicular to the described planes. Here the control cam 22 consists of two rigidly fixed together sub-cams 22*a*, 22*b* which are moveable about a common axle; it can also be chosen in a different form. The sub-cam 22*a* interacts with the stationary guiding face 32, the sub-cam 22*b* with the moveable guiding face 82. According to the setting of the moveable control guide 80, one of these guiding faces 32, 82 is arranged in direct contact with the control cam 22 and, thus, acts as the active guiding face. Its shape, thus, determines the time course of the orientation during the movement of the gripper along the orbital track and correspondingly, whether the grippers 12 are in their normal orientation before the closing location 34 or are pivoted at the position 84 in order to reject a product 60.

Figure 6C:
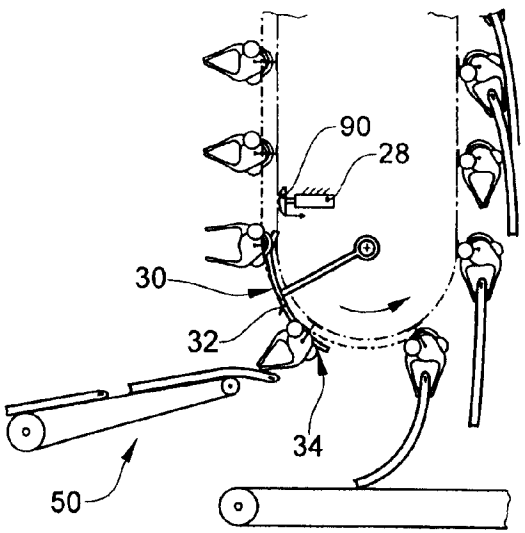
FIG. 6 a device according to the invention with one controllable unlocking element situated before a stationary control guide.
Figure 6B:
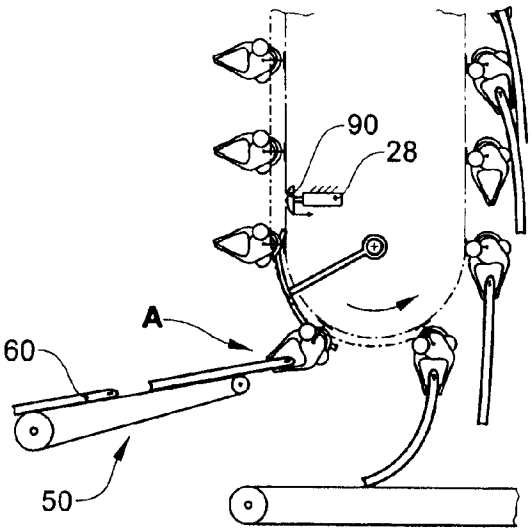
Figure 6A:
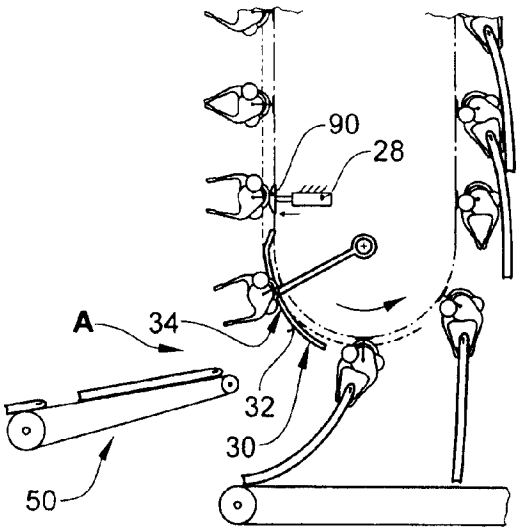

FIGS. 6*a-c* depicts three snapshots of a further example of a device with a controllable guide, here a controllable opening guide (unlocking element 28) for the selective rejection of individual products 12. The fundamental design is like that of FIGS. 1*a+b*. Differently from that, however, each gripper 12 is closed above the transfer area A at a closing location not shown here. Immediately before the closing guide 30 described above, the controllable opening guide in the form of an opening element 28 is arranged, and e.g. is designed as already described with reference to FIG. 3. By means of this opening element 28 the grippers 12 that arrive in their closed position are selectively unlocked and opened at a first opening position 90 for the purpose of taking up a product. They are thus ready for the taking-up of a product 60 in the transfer area A and are closed, as described above, by the stationary closing guide 30 while gripping a product 12 (FIGS. 6*a*+*b*). If a product 60 should selectively be rejected, the opening element 28 is not activated. The corresponding gripper 12 thus remains closed (FIG. 6*b*). Because of the locking, the closing guide in this case has no influence on the position of the two gripper parts 14, 16 relative to one another, but at most influences the position of the gripper 12 in space. The gripper 12 is thus moved through the transfer area A in a closed position and cannot take up a product 60 (FIG. 6*c*). Preferably the gripper 12, as already described with reference to FIG. 4, is oriented in such a way that products 60 to be rejected are deflected downward.

This variant has the advantage that simply an opening element 28 as well as an additional stationary control guide must be used upstream of the stationary closing guide 30 in the transfer area A.

Figure 7A:
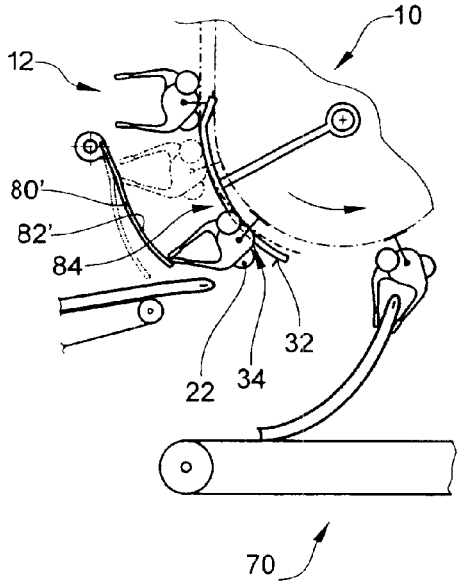
FIG. 7 a device according to the invention with a pivotable control guide that interacts with one of the gripper parts.
Figure 7B:
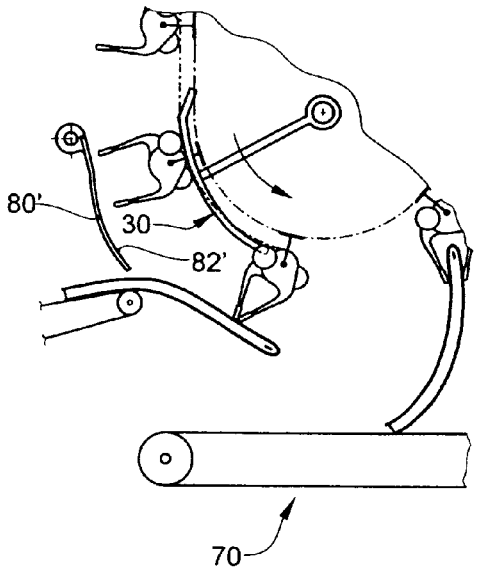

FIGS. 7*a*+*b* depicts two snapshots of a further variant based upon FIGS. 1*a*+b, with a moveable control guide 80' situated outside of the actual gripper conveyor 10. The control guide 80' features a guiding face 82' which is pivotable between two end positions (shown in FIG. 7*a* by solid and/or dotted lines) about an axis that runs perpendicular to the plane of the drawing. It can also be slideable rather than pivotable. In its inactive position in FIG. 7*b* the moveable control guide 80' does not contact the grippers 12. These are thus, as described above with reference to FIGS. 1*a*+*b*, closed by the stationary control guide 30.

In the active position in FIG. 7*a*, the leading gripper part 14 glides along the guiding face 82' and makes contact thereto. That the guiding face 82' is not deflected, the gripper part 14 is pivoted by the opposing force of the guiding face 82' relative to the rest of the gripper 12, whereby it lifts the control cam 22 that is associated to it from the stationary control guide 30 and/or the guiding face 32. The gripper part 14 is thus pivoted. Thereby it is achieved that the course of the gripper tip does not intersect with a product and no transfer takes place. The pivoting again occurs without substantial application of force, such that the gripper 12 is not locked. This movement is independent from the stationary control guide 30 and occurs in a further location 84 that is before the normal closing position 34 with respect to the direction of the orbit. With further movement of the gripper 12 the influence of the moveable guiding face 82' ends, and the gripper again takes up its normal position, which is defined by the stationary guide 30. It is thus closed at the normal closing location 34. According to the shape of the further guide 80', it can be achieved that the gripper 12 in a preferable manner rapidly returns to its normal position and pushes away the rejected product downwards.

The movable control guide 80', and in particular its guiding face 82' and/or the respective parts thereof that can interact with the gripper part 14, is designed to be short enough that a switching between two grippers 12 and therein a selective control of individual grippers 12 is possible. The moveable control guide 80' can again be designed with a relatively light construction such that the rapid pivoting-away of the gripper part 14 can occur without substantial application of force.

Figure 8:
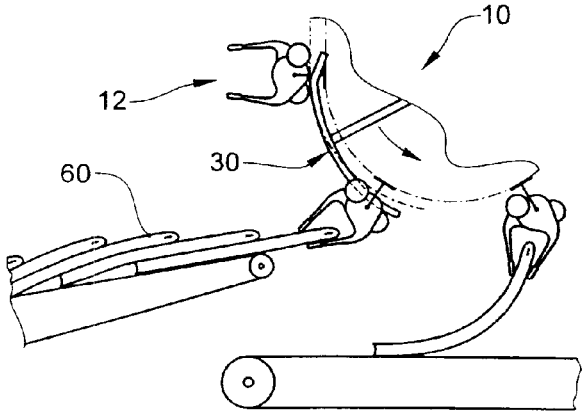
FIG. 8 a detailed view of the device from FIG. 1 or 6 as it takes up products from a shingle stream.

FIG. 8 depicts the taking-up of products 60 from a shingle stream. Since the leading edge of the products 60 are gripped and/or not gripped, shingle streams can be used with all of the devices depicted above.

The invention claimed is:

1. A conveyor system for flat products, in particular print shop products, comprising:

a feeder device, as well as a gripper conveyor with a plurality of grippers which move along an orbital track (U), wherein each gripper comprises two gripper parts which can be pivoted relative to one another between an open position and a closed position, whose orientation relative to one another and relative to the orbital track is dependent upon their position along the orbital track and is set by means of at least one control device, which features at least one control guide that interacts with the grippers, such that gripper parts in a transfer area (A) of the orbital track (U) can be transferred from the open position to the closed position for the transfer of the products from the feeder device, and wherein the grippers can be controlled by the control device in such a way that selectively individual grippers can be moved through the transfer area (A) without taking up a product from the feeder device.

2. The conveyor system according to claim 1, wherein the control device features at least one controllable control guide with at least one movable element.

3. The conveyor system according to claim 2, wherein the at least one controllable control guide comprises at least one guiding face, which is capable of interacting with a control element on the gripper or with a gripper part in order to effect the adjustment of the position of the gripper parts relative to one another and/or the adjustment of the orientation of the gripper relative to the orbital track (U).

4. The conveyor system according to claim 3, wherein the position of the guiding face with respect to the orbital track (U) can be altered in a controller manner.

5. The conveyor system according to claim 3, wherein a stationary control guide is present, with a first guiding face as well as a movable control guide with a further guiding face, wherein depending upon the position of the movable control guide, the first guiding face or the further guiding face interacts with the gripper.

6. The conveyor system according to claim 1, wherein the gripper conveyor is arranged relative to the feeder device such that as the grippers move along the orbital track (U) they approach the transfer area (A) of the feeder device from above.

7. The conveyor system according to claim 6, wherein the orientation of the gripper parts in the transfer area (A) as well as the position of the feeder device are selected such that the products are moved by the feeder device between these gripper parts in the case of open grippers, or in the case of closed grippers, are moved beneath the gripper parts that are facing the feeder device.

8. The conveyor system according to claim 7, wherein in the gripper's closed position, the gripper part facing the feeder device is capable of deflecting a product downwards.

9. The conveyor system according to claim 1, further comprising a control unit that is capable of affecting the opening and closing device.

10. The conveyor system according to claim 9, further comprising a detection device, that is an optical sensor, and which is capable of detecting the presence of a product that is not to be transferred and transmitting a corresponding signal to the control unit.

11. A gripper conveyor with a plurality of grippers that are moved along an orbital track (U), each gripper comprising two gripper parts that can be pivoted relative to one another between an open position and a closed position, and with a controllable opening and closing device with at least one control guide by means of which the position of the gripper parts of individual grippers relative to one another can be adjusted, for use within a conveyor system according to claim 1.

12. A method for conveying flat products, in particular print shop products, with a conveyor system, comprising the following steps:

providing as part of the conveyor system:

a feeder device, as well as a gripper conveyor with a plurality of grippers which move along an orbital track (U), wherein each gripper comprises two gripper parts which can be pivoted relative to one another between an open position and a closed position, whose orientation relative to one another and relative to the orbital track is dependent upon their position along the orbital track and is set by means of at least one control device, which features at least one control guide that interacts with the grippers, such that gripper parts in a transfer area (A) of the orbital track (U) can be transferred from the open position to the closed position for the transfer of the products from the feeder device, and wherein grippers can be controlled by the control device in such a way that selectively individual grippers can be moved through the transfer area (A) without taking up a product from the feeder device;

conveying the products with the feeder device;

gripping and further conveying the products by the grippers of the gripper conveyor, by means of the gripper parts being brought from the open position to the closed position in the transfer area (A);

wherein control of the open and/or closed position of the grippers is performed in such a way that selectively individual grippers can be moved through the transfer area (A) without taking up a product from the feeder device.

13. The method according to claim 12, wherein in the open position the grippers are moved to the transfer area (A) and selectively closed at a first closing location for the taking-up of a product or for the rejection of a product are pivoted, in a conveying direction, at a position before that of the first closed position.

14. The method according to claim 12, wherein the grippers are moved to the transfer area (A) in the closed position, and selectively for the taking-up of a product are opened at a first opening location and subsequently closed at a first closing location, or for the rejection of a product are moved through the transfer area (A) in the closed position.

15. The method according to claim 13, wherein the gripper part that faces the feeder device, when moved in its closed position through the transfer area (A) by the movement of the grippers, serves to deflect a product downwards.

16. The method according to claim 12, wherein the grippers are moved in the open position to the transfer area (A), and selectively are closed at a first closing location for the taking-up of a product, or for the rejection of a product are moved through the transfer area (A) in the open position.

* * * * *